US006293739B1

(12) United States Patent
Uchino et al.

(10) Patent No.: US 6,293,739 B1
(45) Date of Patent: Sep. 25, 2001

(54) COATED CEMENTED CARBIDE CUTTING TOOL

(75) Inventors: Katsuya Uchino; Akihiko Ikegaya, both of Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/423,353

(22) PCT Filed: Apr. 13, 1999

(86) PCT No.: PCT/JP99/01964

§ 371 Date: Nov. 23, 1999

§ 102(e) Date: Nov. 23, 1999

(87) PCT Pub. No.: WO99/52662

PCT Pub. Date: Oct. 21, 1999

(30) Foreign Application Priority Data

Apr. 14, 1998 (JP) ..... 10/101658

(51) Int. Cl.[7] ..... B23B 27/14; B23P 15/28

(52) U.S. Cl. ..... 407/119; 407/118; 428/216

(58) Field of Search ..... 407/118, 119; 428/216, 334, 335, 336, 469, 697, 698, 701

(56) References Cited

U.S. PATENT DOCUMENTS 5,162,147 * 11/1992 Ruppi ..... 407/119 X
5,681,651 * 10/1997 Yoshimura et al. ..... 407/119 X
5,766,782 * 6/1998 Ljungberg ..... 428/698
5,786,069 * 7/1998 Ljungberg et al. ..... 428/216
5,861,210 * 1/1999 Lenander et al. ..... 407/119 X
5,863,640 * 1/1999 Ljungberg et al. ..... 428/216
5,942,318 * 8/1999 Soderberg et al. ..... 428/216
5,945,207 * 8/1999 Kutscher et al. ..... 428/216
6,015,614 * 1/2000 Ruppi ..... 407/119 X
6,062,776 * 5/2000 Sandman et al. ..... 407/119

FOREIGN PATENT DOCUMENTS 64-83662 3/1989 (JP) .
7-112306 5/1995 (JP) .
8-90311 4/1996 (JP) .
9-125250 5/1997 (JP) .
9-136202 5/1997 (JP) .
9-507528 7/1997 (JP) .
WO 95/19457 7/1995 (WO) .

* cited by examiner

*Primary Examiner*—Henry Tsai
(74) *Attorney, Agent, or Firm*—McDermott, Will & Emery

(57) ABSTRACT

The invention is to prolong the life time of tools dramatically by (1) considerably improving the flaking resistance of the coating layer at the time of cutting, (2) increasing the wear resistance and crater resistance of the coating layer itself, and (3) enhancing the breakage strength of the coating layer in comparison with the conventional coating cutting tools. In order to achieve the object, the coated cemented carbide of the invention has the following structure in the coating layer on the surface of the cemented carbides: The outer layer has an $Al_2O_3$ layer practically having an $\alpha$-type crystal structure. The $Al_2O_3$ layer has a region where $\alpha$-type and $\kappa$-type crystal grains coexist in the first row of the crystal grains that grow on the inner layer. In addition to that, the crystal grains of $\alpha$-$Al_2O_3$ in the region include no pores.

21 Claims, No Drawings

COATED CEMENTED CARBIDE CUTTING TOOL

TECHNICAL FIELD

The present invention relates to a coated cemented-carbide cutting tool that has high toughness and superior wear resistance.

BACKGROUND ART

Prolongation of the tool life has been practiced by depositing titanium carbide, titanium nitride, titanium carbonitride, $Al_2O_3$, or another coating layer on the surface of a cemented-carbide cutting tool. Chemical vapor deposition (CVD), plasma CVD, and physical vapor deposition processes have been widely used for providing the coating layer.

However, the wear resistance of the coating layers has been insufficient, and the tool life has been shortened due to damage to or flaking of the coating layer when these coated cemented-carbide cutting tools are used particularly for the following machining: (1) machining, such as high-speed cutting of steel or high-speed machining of cast iron, that requires wear resistance and crater resistance in the coating layer at high temperatures, and (2) machining, such as small-parts machining, that has many machining processes and many leading parts on the workpiece.

In order to surmount these problems, controlling the structure and oriented texture of the coated layer has been studied on the multiple coated-layer structure in which the outer layer comprises $Al_2O_3$ and the inner layer comprises titanium carbide or titanium carbonitride, for example, which is superior in hardness as well as in bonding with cemented carbides. For example, published Japanese patent application Tokuhyohei 9-507528 has disclosed a coating method in which $Al_2O_3$ having an $\alpha$-type crystal structure, which is stable at high temperatures, is given a certain amount of oriented texture in order to improve the high-temperature properties. Although the $Al_2O_3$ having an $\alpha$-type crystal structure is said to be superior in high-temperature properties, the material is well known to have difficulty in obtaining high bonding strength that prevents flaking at the time of cutting. In the above-mentioned prior technique also endeavor has been made to obtain high bonding strength by controlling the moisture content at the initial stage of the coating of $Al_2O_3$. However, it cannot be said that sufficient bonding strength is obtained by this technique.

DISCLOSURE OF INVENTION

Under these circumstances, an object of the present invention is to prolong the life time of tools extensively and stably by (1) considerably improving the flaking resistance of the coating layer at the time of cutting, (2) increasing the wear resistance and crater resistance of the coating layer itself, and (3) enabling the enhancement of the breakage strength of the coating layer in comparison with the conventional coated cutting tools.

In order to achieve the above-described object, the present invention offers the following structure:

The structure comprises:

a cemented-carbide substrate that comprises a hard phase comprising tungsten carbide as the main constituent and at least one member selected from the group consisting of carbide, nitride, and carbonitride of the metals in the I Va, Va, and V I a groups, and a bonding phase mainly consisting of Co; and a ceramic coating layer on the cemented-carbide substrate, the ceramic coating layer comprising an inner layer and an outer layer.

The inner layer comprises at least one layer of Ti(CwBxNyOz), where w+x+y+z=1, and w, x, y, and z≧0. The outer layer has an $Al_2O_3$layer at the place where the outer layer is in contact with the inner layer. The $Al_2O_3$ practically comprises $\alpha$-$Al_2O_3$. More specifically, the $Al_2O_3$ has a region where grains having an $\alpha$-type crystal structure and grains having a $\kappa$-type crystal structure coexist in the first row of the crystal grains that grow on the inner layer. The crystal grains of the $\alpha$-$Al_2O_3$ in the region include practically no pores.

It is preferable that the outer layer include at least one layer of Ti(CwBxNyOz), where w+x+y+z=1, and w, x, y, and z≧0, in addition to the $Al_2O_3$.

The following effects are attained by the coexistence of the grains having an $\alpha$-type crystal structure and the grains having a $\kappa$-type crystal structure in the first row of crystal grains that grow on the inner layer.

First, high bonding strength between the outer layer and inner layer can be obtained by providing a certain proportion of $Al_2O_3$ having a $\kappa$-type crystal structure, which is superior in bonding to the layer directly underneath, in the first row at the interface with the inner layer. In addition to that, the gradual dominance of the $Al_2O_3$ having an $\alpha$-type crystal structure over the $Al_2O_3$ having a $\kappa$-type crystal structure during the growing process of the $Al_2O_3$ enables the final growth, at the outermost layer, of the $Al_2O_3$ having an $\alpha$-type crystal structure, which has superior mechanical and chemical wear resistance and breakage resistance under high-temperature cutting environments.

Second, the structure having practically no pores in the crystal grains of the $\alpha$-$Al_2O_3$ in the region enables the suppression of the reduction in the bonding strength; this reduction has caused problems in the conventional coated cutting tools having $\alpha$-$Al_2O_3$. The low bonding strength of the conventional $\alpha$-$Al_2O_3$ is attributable to the strength reduction in the coating layer caused by the pores; this strength reduction has generated the mechanism of breakage followed by flaking of the layer.

As described above, the structure of the present invention enables the formation of $\alpha$-$A_2O_3$, which is superior as a coating layer, on the inner layer with substantially high bonding strength, improving the cutting performance extensively.

It is desirable that the inner layer comprise two or more layers of Ti(CwBxNyOz), where w+x+y+z=1, and w, x, y, and z≧0, and that the layers mainly consist of titanium carbonitride having a columnar structure. This constitution enables the attainment of substantially high wear resistance through not only preventing the damage starting at the outer $Al_2O_3$ layer during intermittent cutting and cutting for parts machining, for example, but also preventing coating-layer breakage in the inner layer and separation between the inner layer and the substrate, thus enabling dramatic improvement of the tool performance.

It is desirable that the $Al_2O_3$ having an $\alpha$-type crystal structure in the structure of the present invention have a $\kappa/\alpha$ ratio of 0.25 to 0.75 in the first row lying on the inner layer, where the $\kappa/\alpha$ ratio means the existing ratio of the grains of the $\kappa$-$Al_2O_3$ to the grains of the $\alpha$-$Al_2O_3$. The $\kappa/\alpha$ ratio in this range enables easier concurrent attainment of the high bonding strength and the final coating of the $Al_2O_3$ having an $\alpha$-type crystal structure at the outermost layer. It is preferable that the $\kappa/\alpha$ coexistence not be limited to the first row but extended to the following rows in a manner such that the κ/α ratio decreases in the upward direction from the first row and becomes zero within the coating layer. The reason being that if the κ-type and the α-type coexist only in the first row, strains caused by the abrupt change in the distribution of crystal structure may decrease the strength of the coating layer at this location. It is yet preferable that the coexisting region is limited within 1.5 μm of the interface with the inner layer because if the coexisting region extends beyond this limit, the existence of the $Al_2O_3$ having a κ-type crystal structure begins to worsen the quality of the coating layer.

In the structure of the present invention, the increase in the initial nucleation density in the $Al_2O_3$ layer on the inner layer can increase the bonding strength. This increase in bonding strength is preeminent when the nucleation density has a level such that the majority of the grains in the first row, where α-$Al_2O_3$ and κ-$Al_2O_3$ coexist, on the inner layer have a grain diameter of 500 nm or less.

The grain diameter is determined by the following means in the present invention: First, a cross-sectional micrograph is taken under a transmission electron microscope (TEM) at 50,000 power. Second, the number of grains in the first row is obtained on a 2-μm-long line drawn arbitrarily on the micrograph. Finally, the grain diameter is obtained by dividing 2 μm by the number of grains.

In the structure of the present invention, it is preferable that the $Al_2O_3$ layer have a thickness of 2 to 20 μm. If thinner than 2 μm, the α-$Al_2O_3$ may have difficulty in exercising its effects. If thicker than 20 μm, even the innately strong α-$Al_2O_3$ may lack in strength, causing breakage of the layer during cutting or reduction in the wear resistance of the layer because of the coarsening of the crystal grains resulting from the increase in the layer thickness.

The finally formed $Al_2O_3$ layer was confirmed, by X-ray diffraction from the surface of the coating layer, to have only an α-type crystal structure based on the fact that all the diffraction peaks showed the α-type crystal structure of $Al_2O_3$, i.e., no peak corresponding to the κ-type crystal structure was found.

The existence of α-type and κ-type grains in the initial stage of the coating of the $Al_2O_3$ is determined by analyzing electron-beam diffraction patterns by a TEM. Ten or more grains are sampled arbitrarily from the first row on the interface with the inner layer for the analysis. The grains in the second and following rows are analyzed by the same method. The analysis is continued until a row is found in which no κ-type grain is detected. The rows beyond this row are judged to have only an α-type crystal structure on the basis of the above results as well as on the fact that the X-ray diffraction from the surface shows only the α-type crystal structure. The presence or absence of pores in the layer of the $Al_2O_3$ having an α-type crystal structure is judged by using cross-sectional micrographs obtained through a TEM at 50,000 power.

It is preferable that the outermost layer, which is in contact with the $Al_2O_3$ in the outer layer, of the inner layer have an acicular microstructure in which needle-shaped crystals have a thickness of 200 nm or less. This facilitates the formation of fine, uniform grains in the first row of the $Al_2O_3$ layer lying on the inner layer and prevents the strength reduction in the $Al_2O_3$ caused by the coarsening of the grains after the coating.

It is preferable that the outermost layer of the inner layer comprise Ti(CwBxNyOz), where w+x+y+z=1 and x≧0.05. The inclusion of boron enables the suppression of the oxidation of the inner layer at the surface at the initial coating stage of the $Al_2O_3$ and strengthens further the bonding between the $Al_2O_3$ layer and the outermost layer of the inner layer.

In the structure of the present invention, it is preferable that the oriented texture coefficient TCa of the $Al_2O_3$ having an α-type crystal structure satisfy TCA(012)>1.3 or satisfy TCa(104)>1.3 and TCa(116)>1.3.

Equation 1:

$$TCa(hkl) = \frac{I(hkl)}{I0(hkl)}\left\{\frac{1}{6}\sum \frac{I(hkl)}{I0(hkl)}\right\}^{-1},$$

where I(hkl): measured diffraction intensity of the (hkl) plane,

I0(hkl): powder diffraction intensity of the (hkl) plane of the $Al_2O_3$ having an α-type crystal structure according to the ASTM Standard, and (hkl): (012), (104), (110), (113), (024), and (116) planes.

The structure of the present invention enables concurrent increase in strength and hardness of the coating layer and also enables prolongation of tool life resulting from the improvement of the wear resistance and chipping resistance of the coating layer.

It is yet preferable that the oriented texture coefficient TC of the titanium carbonitride layer having a columnar structure in the inner layer take the highest value in TC(311) that is not less than 1.3 and not more than 3 or have both TC(422) and TC(311) not less than 1.3 and not more than 3, where TC(422) means the oriented texture coefficient of the (422) plane, and TC(311) of the (311) plane.

Equation 2:

$$TC(hkl) = \frac{I(hkl)}{I0(hkl)}\left\{\frac{1}{8}\sum \frac{I(hkl)}{I0(hkl)}\right\}^{-1},$$

where I(hkl): measured diffraction intensity of the (hkl) plane,

I0(hkl): average value of the powder diffraction intensity of the (hkl) planes of TiC and TiN according to the ASTM Standard, and (hkl): (111), (200), (220), (311), (331), (420), (422), and (511) planes (total 8 planes).

The oriented texture coefficient lying in the range of the present invention enables considerable increase in the breakage resistance of the film of the inner layer and prevents minute chipping of the film, thus substantially increasing the wear resistance. If, however, the oriented texture coefficient exceeds 3, the breakage resistance of the coating layer decreases because of the excessively intensified orientation to a certain direction.

The synergism of the above-described effects resulting from the combination of the quality and the structure of the inner and outer layers enables the dramatic prolongation of tool life.

The following is an explanation of the method for fabricating the structure of the present invention.

First, the titanium carbonitride of the present invention is deposited in an atmospheric gas of $TiCl_4$, $CH_3CN$, $N_2$, and $H_2$. The coating conditions for the first half are different from those for the second half as follows: The ($TiCl_4$+$CH_3CN$)/total-gas-volume ratio for the first half (for 120 minutes from the start of coating) is lower than that for the second half, and the $N_2$/total-gas-volume ratio for the first half is two or more times that for the second half. The structure of the present invention is obtained under this condition. The titanium carbonitride layer having a thickness less than 10 μm enables the oriented texture coefficient TC(311) to be not less than 1.3 and not more than 3. The coating layer having a thickness of 10 μm or more enables both TC(311) and TC(422) to be not less than 1.3 and not more than 3.

Next, the $Al_2O_3$ of the present invention is produced by the ordinary CVD process using $Al_2O_3$ and $CO_2$ as the material gas.

The following is an explanation of the specific method for producing the coexisting region of the α-type structure and the κ-type structure at the initial formation stage of the $Al_2O_3$ layer. First, the coating is conducted up to the inner layer immediately underneath the $Al_2O_3$ layer. Second, after the cleaning of the inside of the coating furnace with an $H_2$ atmosphere, $CO_2$ and $Al_2O_3$ are introduced concurrently. During this period, the initial $CO_2$ volume is changed until the steady coating condition is established. More specifically, the initial-$CO_2$-volume/steady-$CO_2$-volume ratio is increased steplessly or stair-steppedly from 0.1 up to 1.0 in 3 to 15 minutes. The temperature is maintained between 950 and 1050° C. during this period. This condition enables the formation of the α-$Al_2O_3$ layer that has the coexisting region of α-type and κ-type structures at the initial stage without regard to the temperature for the coating of the $Al_2O_3$. The establishment of this initial condition can control the existing ratio of the α-type to the κ-type and the thickness of the initial layer. This controls the oriented texture coefficient of the finally coated $Al_2O_3$ layer. The oriented texture coefficient can also be changed by changing the thickness of the $Al_2O_3$ layer produced under the same oxidative condition.

If the initial condition deviates from the above-described specifications, the effects of the present invention cannot be exercised as shown below. (1) The coexisting region of the α-type and the κ-type at the initial stage may not be obtained. (2) Even if the coexisting region is obtained, a κ-$Al_2O_3$ layer may be formed finally. (3) Even if the coexisting region is obtained, a number of pores are included in the grains of the $Al_2O_3$ having an α-type crystal structure as has been experienced in the conventional α-$Al_2O_3$.

After the coating, when the coated surface is treated with the blasting process or a mechanical process such as brushing until the $Al_2O_3$ layer at the cutting edge of a tool becomes smooth or thin in comparison with the other portions or is removed, the above-described effects are further enhanced. The effects are still upgraded when the $Al_2O_3$ layer at the cutting edge has a surface roughness Rmax of 0.4 μm or less, where the roughness is measured over a length of 10 μm. It is yet desirable that the outermost layer of the cutting edge be made of $Al_2O_3$ or the exposed inner layer and that the outermost layer of the portions other than the cutting edge be made of TiN. Damage caused by the deposition of the workpiece at the portions other than the cutting edge under some cutting conditions can be suppressed by the effect of the TiN, which is superior in deposition resistance.

An additional explanation about the extent of this treatment is given below. In order to obtain the effect of the present invention, it is necessary for the $Al_2O_3$ layer at the cutting edge to become smooth or thin or to be removed without fail at the edge portion that is actually touched by chips at the time of cutting, but the $Al_2O_3$ layer at the cutting edge remote from the edge portion that is touched by chips may remain without becoming thin or without being removed. Although the present invention specifies that the $Al_2O_3$ layer become smooth or thin or be removed only at the cutting edge, this treatment may be given to angular portions that have no direct relation with cutting, such as the peripheral portions of the bearing surface in a cutting tool, without practically altering the effect of the present invention.

The above-described surface treatment for the coating layer can also reduce the residual tensile stress in the coating layer down to 10 kg/mm$^2$ or below at the TiCN layer in the inner layer, thus enhancing the breakage resistance of the coating layer.

When a cemented-carbide substrate is toughened at the surface region by reducing or removing the hard phase excluding tungsten carbide in a manner such that the region has a thickness not less than 10 μm and not more than 50 μm at the portions other than the cutting edge and is combined with the coating layer and surface treatment of the present invention, damage in which the coating layer disappears together with some portions near the surface of the cemented carbides can be prevented with remarkable effectiveness.

Containing Zr in the cemented carbide substrate is especially preferable. All the Zr does not dissolve into the binder phase of cemented carbide, but at least some of the Zr constitutes some of the hard phase. This enables further improvement in the hardness and strength properties of the substrate at high temperatures.

In the structure of the present invention, when the surface region has a hardness lower than the average hardness in the interior of the substrate and the region immediately beneath the surface region has a hardness higher than the interior of the substrate, the improvement is further remarkable in the toughness resulting from the effect of the surface region as well as in the plastic-deformation resistance because of the high-hardness region.

The reason why the present invention specifies that the surface region of the substrate have a thickness not less than 10 μm and not more than 50 μm is as follows: If more than 50 μm, the surface region tends to produce slight plastic deformation or elastic deformation during cutting. If less than 10 μm, the effect for increasing toughness is minimized.

The above-described surface region can be produced by the following commonly known methods: One method uses a hard-phase material that contains nitrogen and the other uses a nitrogen-containing atmosphere at the temperature-rising period in the sintering process and changes this atmosphere to a denitrified, decarbonized atmosphere after a liquid phase appears in the bonding phase.

BEST MODE FOR CARRYING OUT THE INVENTION

EXAMPLE 1

WC-based cemented-carbide substrates were prepared that comprise 8% Co, 2% TiC, 2% TaC, and WC as the remainder and that have a shape of CNMG120408. Four types of inner-layer structures shown in Table 1 were provided on the substrates. Subsequently, the outer layers shown in Table 2 were laminated on the inner layers. The adopted initial coating conditions of the $Al_2O_3$ are shown in Table 3 as A to E (F and G are comparative examples). The samples fabricated under these conditions in combination are shown in Table 4, in which the same symbols as in Tables 1 to 3 are used.

TABLE 1

| | No. | Inner-layer Outer-layer side← →Substrate side | Oriented texture coefficient of the TiCN layer (311) | (422) |
|---|---|---|---|---|
| Samples of the present invention | 1a | TiBN(0.5)/TiCN(12)/TiN(1) | 1.3 | 3.0 |
| | 2a | TiBN(0.5)/TiCN(8)/TiN(1) | 3.0 | 1.3 |
| | 3a | TiBN(0.5)/TiCN(6)/TiN(1) | 3.0 | 1.0 |
| | 4a | TiC(3)/TiCN(2) | 1.3 | 0.9 |

*: Numbers 2a and 3a have an oriented texture coefficient TC(311) higher than any other coefficient.

TABLE 2

| | No. | Outer-layer structure Outermost layer← →Innermost layer |
|---|---|---|
| Samples of the present invention | 1b | $TiN(3)/Al_2O_3(2)$ |
| | 2b | $TiN(0.5)/TiC(0.5)/Al_2O_3(10)$ |
| | 3b | $Al_2O_3(20)$ |
| | 4b | $TiN(0.5)/Al_2O_3(7)$ |
| Comparative samples | 5b | $TiN(1)/Al_2O_3(1.5)$ |
| | 6b | $Al_2O_3(22)$ |

TABLE 3

| | No. | Initial $CO_2$/steady $CO_2$ | Initial treatment time (min) | κ/α ratio in the first row | Thickness of the coexisting region (μm) |
|---|---|---|---|---|---|
| Samples of the present invention | A | 0.3→2 | 10 | 0.25 | 0.8 |
| | B | 0.1→2 | 5 | 0.75 | 1.5 |
| | C | 0.4→2 | 15 | 0.2 | 0.5 |
| | D | 0.1→2 | 3 | 0.8 | 2.0 |
| | E | 0.1→2 | 10 | 0.45 | 1.2 |
| Comparative samples | F | 0.1 | 2 | 1.0 | — |
| | G | 2 | 16 | 0.05 | 0.5 |

*: Numbers B and C were confirmed to have a κ/α coexisting region in which the κ/α ratio decreases in the upward direction.

TABLE 4

| | Sample No. | Inner-layer structure | Outer-layer structure | Initial coating condition of the $Al_2O_3$ | Oriented texture coefficient of the $Al_2O_3$ (012) | (104) | (116) |
|---|---|---|---|---|---|---|---|
| Samples of the present invention | 1 | 1a | 1b | A | 0.8 | 1.3 | 1.6 |
| | 2 | 1a | 1b | B | 1.3 | 1.2 | 0.8 |
| | 3 | 1a | 1b | C | 1.0 | 1.3 | 1.3 |
| | 4 | 3a | 3b | E | 0.6 | 3.1 | 1.3 |
| | 5 | 2a | 4b | E | 0.7 | 2.8 | 1.4 |
| | 6 | 2a | 2b | D | 1.1 | 1.1 | 1.1 |
| | 7 | 4a | 1b | E | 1.1 | 1.3 | 1.5 |
| Comparative samples | 8 | 3a | 3b | F | — | — | — |
| | 9 | 2a | 4b | G | 1.1 | 1.3 | 1.2 |
| | 10 | 1a | 5b | E | 1.0 | 1.2 | 1.2 |
| | 11 | 4a | 6b | E | 0.6 | 3.3 | 1.1 |

The TiCN layers in Table 1 used in the inner layers of the present invention were broken after the coating to observe the broken sections with a scanning electron microscope (SEM); the results demonstrated that all the TiCN layers have a columnar structure. The TiBN layers used as the outermost layer have a uniform thickness and an acicular microstructure in which needle-shaped crystals have a thickness of 200 nm or less. The TiBN layers were analyzed by energy dispersive X-ray spectroscopy (EDX) which detected oxygen contained in the layers although the quantity is unknown. A sample having only an inner layer formed in the 3a condition was prepared and analyzed quantitatively from the surface by electron spectroscopy for chemical analysis (ESCA). As a result, it was confirmed that the sample contained boron with a proportion of 5/100.

Table 1 also shows the oriented texture coefficients of the (311) and (422) planes of the TiCN layers in the inner layers.

The oriented texture coefficient of the TiCN layer in the inner layer was obtained from the diffraction peak of X-ray diffraction. Because the diffraction peak of the (311) plane of TiCN overlaps the diffraction peak of the (111) plane of WC in the substrate, it is necessary to separate them. Because the peak intensity of the (111) plane of WC is ¼ the peak intensity of the (101) plane, which is the highest intensity in WC, calculation was made to obtain the peak intensity of the (111) plane of WC and this calculated value was subtracted from the peak intensity measured at the place for the (311) plane of TiCN to obtain the true peak intensity of the (311) plane of TiCN.

Table 3 includes data obtained on the samples produced under the individual initial coating conditions; the data are the κ/α ratio of the grains at the first row and the thickness of the region in which the κ-type and α-type structures coexist. The cross section in the vicinity of the interface between the inner layer and the neighboring $Al_2O_3$ layer was observed under a TEM at 50,000 power; the oriented texture of the $Al_2O_3$ was evaluated by X-ray diffraction from the surface of the individual samples after the coating. The results for the samples of the present invention confirmed that (1) 90% or more grains in the first row have a granular structure 500 nm or less in grain diameter, (2) the grains having an α-type crystal structure in this region include no pores, and (3) the outermost layer in the outer layer has only an α-type crystal structure because a κ-type was not detected by X-ray diffraction from the surface. On the other hand, a comparative sample F has no coexisting region of κ-type and α-type structures in the initial stage and has a κ-type crystal structure in the outermost layer. The results for comparative sample G confirmed that (1) the coexisting region is present, (2) the outermost layer has an α-type crystal structure, (3) the α-type grains in the coexisting region in the first row include a number of pores, and (4) the crystal grains in the first row are coarse as a whole to such an extent that most grains have a diameter not less than 600 nm.

Table 4 includes the oriented texture coefficients of the (012), (104), and (116) planes of the $Al_2O_3$.

The coating conditions used for the individual layers are as follows:

TiN layer:

Temperature: 860° C.,

Pressure: 200 torr,

Composition of the reaction gas: 48 vol. % $H_2$, 4 vol. % $TiCl_4$, and 48 vol. % $N_2$.

TiCN layer for Samples 1 to 3 of the present invention:

For the first half (120 minutes) of the coating process:

Temperature: 920° C.,

Pressure: 50 torr,

Composition of the reaction gas: 68 vol. % $H_2$, 1.7 vol. % $TiCl_4$, 0.3 vol. % $CH_3CN$, and 30 vol. % $N_2$.

For the second half (the remainder) of the coating process:

Temperature: 920° C.,

Pressure: 50 torr,

Composition of the reaction gas: 78 vol. % $H_2$, 6 vol. % $TiCl_4$, 1 vol. % $CH_3CN$, and 15 vol. % $N_2$.

TiBN layer:

Temperature: 950° C.,

Pressure: 360 torr,

Composition of the reaction gas: 46 vol. % $H_2$, 4 vol. % $TiCl_4$, 48 vol. % $N_2$, and 2 vol. % $BCl_3$.

$Al_2O_3$ layer:

Temperature: 1000° C.,

Pressure: 50 torr,

Composition of the reaction gas: 86 vol. % $H_2$, 9 vol. % $AlCl_3$, and 5 vol. % $CO_2$.

TiC layer:

Temperature: 1020° C.,

Pressure: 50 torr,

Composition of the reaction gas: 90 vol. % $H_2$, 3 vol. % $TiCl_4$, and 7 vol. % $CH_4$.

Samples fabricated under the above-described conditions were evaluated by the cutting conditions 1 and 2 below:

Cutting condition 1:

Workpiece: SCM415 (HB=170) with 4 grooves,

Cutting speed: 350 m/min,

Feed: 0.20 mm/rev,

Depth of cut: 1.5 mm,

Number of impacts given: 500 times,

Cutting oil: water-soluble oil.

The results of the evaluation are shown in Table 5.

TABLE 5

| | Sample No. | Flank wear | Cutting condition 1: Crater wear | Coating layer chipping, boundary breakage, etc. |
|---|---|---|---|---|
| Samples of present invention | 1 | 0.18 | Very small | None |
| | 2 | 0.20 | Small | None |
| | 3 | 0.17 | Very small | Slight flaking and chipping at boundaries |
| | 4 | 0.21 | None | None |
| | 5 | 0.19 | None | None |
| | 6 | 0.20 | None | Slight chipping at boundaries |
| | 7 | 0.24 | Very small | None |
| Comparative samples | 8 | 0.33 | Large | Many chipped parts in the coating layer at the cutting edge |
| | 9 | 0.30 | Large (flaking of the $Al_2O_3$) | Many flaked parts in the coating layer at the cutting edge |
| | 10 | 0.19 | Large | None |
| | 11 | 0.29 | None | Many chipped parts in the coating layer at the cutting edge |

Cutting condition 2:

Workpiece: FC25,

Cutting speed: 350 m/min,

Feed: 0.3 mm/rev,

Depth of cut: 1.5 mm,

Cutting time: 20 min,

Cutting oil: water-soluble oil.

The results of the evaluation are shown in Table 6.

TABLE 6

| | Sample No. | Cutting condition 1: Flank wear | Crater wear | Coating layer chipping, boundary breakage, etc. |
|---|---|---|---|---|
| Samples of present invention | 1 | 0.16 | Small | None |
| | 2 | 0.17 | Small | None |
| | 3 | 0.15 | Small | Flaking and chipping at boundaries |
| | 4 | 0.19 | None | Slight chipping at boundaries |
| | 5 | 0.16 | None | None |
| | 6 | 0.17 | None | High moderate chipped parts at boundaries |
| | 7 | 0.24 | Small | None |
| Comparative samples | 8 | 0.68 (crater breakage) | Very large | Severe damage at boundaries |
| | 9 | 0.40 | Very large | Very severe boundary flaking |

TABLE 6-continued

| Sample No. | Cutting condition 1 Flank wear | Crater wear | Coating layer chipping, boundary breakage, etc. |
|---|---|---|---|
| | | (with flaking) | |
| 10 | 0.49 (crater breakage) | Very large | None |
| 11 | 0.42 | Small (with chipping) | Severe boundary chipping and damage |

These results demonstrate that the samples of the present invention have a coating layer superior to that of conventional products in wear resistance, flaking resistance, chipping resistance, and crater resistance. Observations of these samples after the cutting test revealed that the samples coated with TiN as the outermost layer show less deposition of the workpiece on the face as a whole than the samples that have exposed $Al_2O_3$. Although the type of the outermost layer has no direct relation with the amount of wear within the scope of this evaluation test, it may affect the damage on the face as the cutting proceeds.

EXAMPLE 2

Samples 3, 4, and 6 prepared in Example 1 were used for this example. The surface of the coating layer was treated with a nylon brush containing SiC. The duration of the surface treatment was changed to provide samples with different degrees of treatment. Samples treated for 1, 5, and 10 minutes are referred to as H1, H5, and H10, respectively. Table 7 shows the ratio of the thickness of the $Al_2O_3$ layer at the cutting edge to that at the portions other than the cutting edge, the surface roughness of the coating layer at the cutting edge, and the residual tensile stress at the cutting edge on the individual samples.

TABLE 7

| Sample | Thickness ratio of the $Al_2O_3$ layer at the cutting edge to that at other portions | Surface roughness of the coating layer at the cutting edge Rmax ($\mu$m) | Residual tensile stress in the TiCN at the cutting edge (kg/mm$^2$) |
|---|---|---|---|
| 3 | 1 | 0.50 | 32 |
| 3H1 | 1 | 0.40 | 29 |
| 3H5 | 0.5 | 0.31 | 12 |
| 3H10 | 0 | 0.25 | 9 |

TABLE 7-continued

| Sample | Thickness ratio of the $Al_2O_3$ layer at the cutting edge to that at other portions | Surface roughness of the coating layer at the cutting edge Rmax ($\mu$m) | Residual tensile stress in the TiCN at the cutting edge (kg/mm$^2$) |
|---|---|---|---|
| 4 | 1 | 0.65 | 27 |
| 4H1 | 1 | 0.51 | 24 |
| 4H5 | 0.95 | 0.30 | 13 |
| 4H10 | 0.9 | 0.29 | 8 |
| 6 | 1 | 0.48 | 29 |
| 6H1 | 1 | 0.36 | 27 |
| 6H5 | 0.9 | 0.26 | 12 |
| 6H10 | 0.8 | 0.27 | 6 |

The residual tensile stress was obtained by using an X-ray analyzing device with the sin 2ψ method on the TiCN layer in the inner layer. These samples were subjected to the same cutting evaluation tests as in Example 1; the results are shown in Tables 8 and 9.

TABLE 9

| | Sample No. | Cutting condition 2 Flank wear | Crater wear | Coating layer chipping, boundary breakage, etc. |
|---|---|---|---|---|
| Samples of present invention | 3H1 | 0.14 | Small | Chipping at boundaries and slight flaking |
| | | | | Slight chipping at boundaries |
| | 3H5 | 0.12 | Small | None |
| | 3H10 | 0.12 | Small | Slight chipping at boundaries |
| | 4H1 | 0.19 | None | Minimal chipped parts at boundaries |
| | 4H5 | 0.18 | None | None |
| | 4H10 | 0.18 | None | High moderate chipped parts at boundaries |
| | 6H1 | 0.16 | None | A few chipped parts at boundaries |
| | 6H5 | 0.13 | None | None |
| | 6H10 | 0.12 | None | |

The results show that the surface treatment enhances the strength of the coating layer and further suppresses the damage attributable to the performance of the coating layer. All the surface-treated samples 3 and 6 showed that whereas the TiN outermost layer was removed at the cutting edge, it remained at the portions other than the cutting edge. The surface treatment effect was confirmed by the fact that the surface-treated samples not only increased the wear resistance as can be seen in Tables 8 and 9 but also decreased the amount of the deposition of the workpiece at the face in comparison with the samples that have an exposed $Al_2O_3$ layer at the portions other than the cutting edge.

EXAMPLE 3

For this example the same composition as in Sample 6 prepared in Example 1 was employed except the composition of the substrate. The substrate used in Sample 6 is referred to as X; the substrate of which the composition was changed to 8% Co, 2% TiC, 2% ZrC, and WC as the remainder is referred to as Y; the substrate of which the composition was changed to 8% Co, 4% ZrN, and WC as the remainder is referred to as Z.

Substrates X1, Y1, and Z1 were also prepared by sintering the substrates having the same composition as Substrates X, Y, and Z, respectively, under a different condition and named differently; they were sintered in a nitrogen atmosphere having a pressure of 150 torr during the temperature-rising period from 1200 to 1400° C. The surface analysis by an electron probe microanalyzer (EPMA) confirmed that the Zr in Substrates Y, Y1, Z, and Z1 constitutes some of the hard phase. Table 10 shows that the thickness (P) of the layer in which the hard phase except tungsten carbide is removed at the surface region, the hardness difference (Q) of the substrate between the surface region and the interior, and the hardness difference (R) between the high-hardness region immediately underneath the surface region and the interior on the individual samples. The hardness was measured with a micro-Vickers hardness tester at a load of 500 g.

TABLE 10

| Substrate No. | P ($\mu$m) | Q (kg/mm$^2$) | R (kg/mm$^2$) |
|---|---|---|---|
| X | 0 | 0 | 0 |
| X1 | 10 | 210 | 230 |
| Y | 0 | 0 | 0 |
| Y1 | 30 | 200 | 180 |
| Z | 50 | 160 | 0 |
| Z1 | 58 | 180 | 0 |

Samples having these different substrates were prepared under the same condition that was used for Sample 6 in Example 1. These samples were subjected to an evaluation test for the breakage resistance under the cutting condition 3 below and to an evaluation test for the plastic-deformation resistance under the cutting condition 4 below. The test results are shown in Table 9. The breakage rate under the cutting condition 3 was obtained by averaging the data on 24 corners.

Cutting condition 3:
Workpiece: SCM435 (HB=230) with 4 grooves,
Cutting speed: 100 m/min,
Feed: 0.15 to 0.30 mm/rev,
Depth of cut: 1.5 mm,
Cutting time: 30 sec maximum,
Number of corners: 24
Cutting oil: No oil was used.

Cutting condition 4:
Workpiece: SK5,
Cutting speed: 100 m/min,
Feed: 0.4 mm/rev,
Cutting time: 5 min,
Cutting oil: No oil was used.

TABLE 11

| Substrate No. | Cutting condition 3 (breakage rate) (%) | Cutting Condition 4 (plastic deformation) (mm) |
|---|---|---|
| X | 65 | 0.23 |
| X1 | 38 | 0.09 |
| Y | 55 | 0.13 |
| Y1 | 19 | 0.06 |
| Z | 10 | 0.13 |
| Z1 | 8 | 0.18 |

Although the data is not shown, the surface-treated samples referred to as H10 in Example 2 were also evaluated similarly; all the samples showed a decrease in the breakage rate by a factor of 2 or more with practically unchanged plastic-deformation resistance. Substrates Y and Z, which have a composition different from that of Sample 6 in Example 1, showed the same results as Sample 6 when tested by the cutting conditions 1 and 2 in Example 1, which means that the evaluation results are dependent only on the type of the coated layer.

INDUSTRIAL APPLICABILITY

The coated cemented-carbide cutting tool of the present invention exhibits substantially prolonged tool life resulting from the improved wear resistance in the coating layer and the prevention of damage and flaking of the coating layer when used for the following machining in particular: (1) machining, such as high-speed cutting of steel or high-speed machining of cast iron, that requires wear resistance and crater resistance in the coating layer at high temperatures, and (2) machining, such as small-parts machining, that has numerous machining processes and many leading parts on the workpiece.

What is claimed is:

1. A coated cemented-carbide cutting tool comprising:

(1) a cemented-carbide substrate that comprises:
- (a) a hard phase comprising:
  - (a1) tungsten carbide as the main constituent; and
  - (a2) at least one member selected from the group consisting of carbide, nitride, and carbonnitride of the metals in the IVa, Va, and VIa groups; and
- (b) a bonding phase mainly consisting of Co; and (2) a ceramic coating layer on the cemented-carbide substrate, the ceramic coating layer comprising an inner layer in contact with the cemented-carbide substrate and an outer layer on the inner layer, wherein
- (a) the inner layer comprises at least one layer of Ti(CwBxNyOz), where w+x+y+z=1, and w, x, y, and z≧0, and
- (b) the outer layer comprises $Al_2O_3$ comprising grains of $\alpha$-$Al_2O_3$ and a region with a row containing coexisting grains having an $\alpha$-type crystal structure and grains having a $\kappa$-type crystal structure, each in contact with the inner layer, wherein regions having crystal grains of $\alpha$-$Al_2O_3$ have substantially no pores.

2. A coated cemented-carbide cutting tool as defined in claim 1, wherein the outer layer includes at least one layer of Ti(CwBxNyOz), where w+x+y+z=1, and w, x, y, and z≧0.

3. A coated cemented-carbide cutting tool as defined in claim 1, wherein the inner layer comprises two or more layers of Ti(CwBxNyOz), where w+x+y+z=1, and w, x, y, and z≧0, and the layers mainly consist of titanium carbonitride having a columnar structure.

4. A coated cemented-carbide cutting tool as defined in claim 1, wherein the row on the inner layer has a ratio of grains of $\kappa$-$Al_2O_3$ to grains of $\alpha$-$Al_2O_3$ ($\kappa/\alpha$ ratio) of 0.25 to 0.75.

5. A coated cemented-carbide cutting tool as defined in claim 4, wherein the $\kappa/\alpha$ ratio decreases in the upward direction from the row on the inner layer and becomes zero within the coating layer.

6. A coated cemented-carbide cutting tool as defined in claim 4, wherein the coexisting region of $\alpha$-$Al_2O_3$ and $\kappa$-$Al_2O_3$ grains remains within 1.5 $\mu$m of an inter-face with the inner layer.

7. A coated cemented-carbide cutting tool as defined in claim 1, wherein the grains in the row on the inner layer have a granular structure such that the majority of the grains have a diameter of 500 nm or less.

8. A coated cemented-carbide cutting tool as defined in claim 1, wherein the $Al_2O_3$ layer has a thickness of 2 to 20 μm.

9. A coated cemented-carbide cutting tool as defined in claim 1, wherein the inner layer in contact with the $Al_2O_3$ layer has an acicular microstructure in which needle-shaped crystals have a thickness of 200 nm or less.

10. A coated cemented-carbide cutting tool as defined in claim 9, wherein the inner layer in contact with the $Al_2O_3$ layer comprises Ti(CwBxNyOz), where w+x+y+z=1, w, y, and z≧0, and x≧0.05.

11. A coated cemented-carbide cutting tool as defined in claim 1, wherein the $Al_2O_3$ having an α-type crystal structure has an oriented texture coefficient TCa that satisfies TCa(012)>1.3, where the texture coefficient TCa is given by Equation 1 below, Equation 1:

$$TCa(hkl) = \frac{I(hkl)}{I0(hkl)}\left\{\frac{1}{6}\sum \frac{I(hkl)}{I0(hkl)}\right\}^{-1},$$

where I(hkl): measured diffraction intensity of the (hkl) plane,

I0(hkl): powder diffraction intensity of the (hkl) plane of the $Al_2O_3$ having an α-type crystal structure according to the ASTM Standard, (hkl): (012), (104), (110), (113), (024), and (116) planes.

12. A coated cemented-carbide cutting tool as defined in claim 1, wherein the oriented texture coefficient TCa as defined in Equation 1 in claim 11 satisfies TCa(104)>1.3 and TCa(116)>1.3.

13. A coated cemented-carbide cutting tool as defined in claim 3, wherein the titanium carbonitride layer with a columnar structure in the inner layer has an oriented texture coefficient TC that takes the highest value in TC(311) of which the value is not less than 1.3 and not more than 3, where the oriented texture coefficient TC is given by Equation 2 below, Equation 2:

$$TC(hkl) = \frac{I(hkl)}{I0(hkl)}\left\{\frac{1}{8}\sum \frac{I(hkl)}{I0(hkl)}\right\}^{-1},$$

where I(hkl): measured diffraction intensity of the (hkl) plane,

I0(hkl): average value of the powder diffraction intensity of the (hkl) planes of TiC and TiN according to the ASTM Standard, (hkl): (111), (200), (220), (311), (331), (420), (422), and (511) planes (total 8 planes).

14. A coated cemented-carbide cutting tool as defined in claim 13, wherein the oriented texture coefficient TC is not less than 1.3 and not more than 3 in TC(422) and TC(311), where TC(422) means the oriented texture coefficient of the (422) plane, and TC(311) the (311) plane.

15. A coated cemented-carbide cutting tool as defined in claim 1, wherein the $Al_2O_3$ layer at the cutting edge of a cutting tool is thinner than at the portions other than the cutting edge or is absent.

16. A coated cemented-carbide cutting tool as defined in claim 15, wherein the $Al_2O_3$ layer at the cutting edge has a surface roughness Rmax of 0.4 μm or less over a length of 10 μm.

17. A coated cemented-carbide cutting tool as defined in claim 15, wherein the outermost layer of the portions other than the cutting edge is made of TiN.

18. A coated cemented-carbide cutting tool as defined in claim 15, wherein the residual tensile stress in the titanium carbonitride in the inner layer is 10 $kg/mm^2$or less at the cutting edge at least.

19. A coated cemented-carbide cutting tool as defined in claim 1, wherein the surface region of the cemented-carbide substrate has a layer in which the hard phase except tungsten carbide is decreased or removed with a thickness not less than 10 μm and not more than 50 μm at the flat portions.

20. A coated cemented-carbide cutting tool as defined in claim 19, wherein the cemented-carbide substrate includes Zr in such a manner that at least part of the Zr is a member of the constituents of the hard phase.

21. A coated cemented-carbide cutting tool as defined in claim 19, wherein the surface region of the cemented-carbide substrate has a hardness lower than the average hardness in the interior of the substrate and the region immediately beneath the surface region has a hardness higher than the interior of the substrate.

* * * * *